United States Patent [19]

Riley et al.

[11] Patent Number: 4,854,593

[45] Date of Patent: Aug. 8, 1989

[54] FOUR PLAYER BACKGAMMON

[76] Inventors: Dennis S. Riley; Jo F. Riley, both of 1461 John Ringling Pkwy., Sarasota, Fla. 33577

[21] Appl. No.: 19,504

[22] Filed: Feb. 26, 1987

[51] Int. Cl.[4] ..... A63F 3/00

[52] U.S. Cl. ..... 273/248

[58] Field of Search ..... 273/248; D21/24

[56] References Cited

U.S. PATENT DOCUMENTS

| | | | |
|---|---|---|---|
| D. 29,650 | 11/1898 | Williams | D21/24 |
| D. 33,532 | 11/1900 | Leonard | D21/24 |
| D. 33,714 | 12/1900 | Haskell | D21/24 |
| 222,272 | 12/1879 | Harmon | 273/248 |
| 4,058,318 | 11/1977 | Thomas et al. | 273/248 |

FOREIGN PATENT DOCUMENTS

| | | | |
|---|---|---|---|
| 1586176 | 3/1981 | United Kingdom | 273/248 |

OTHER PUBLICATIONS

Montgomery Wards Catalog, 1939–1940, p. 754.

*Primary Examiner*—Edward M. Coven
*Assistant Examiner*—Benjamin Layno

[57] ABSTRACT

A four player backgammon game board in which the game board is designed to have six points of alternating colors located at the middle of each side of a four sided square game board providing twenty-four total points on the game board. Four players are provided with optimally nine stones of a color different than the other players to use on the game board. Each player's outer table, inner table, and direction of play is determined by color coding the game board with bands and arrows. There are three different color coded variations of the basic game board using colors corresponding to the colored stones of the players. At the beginning of each game, each player is required to enter his stones on to his respective color coded outer table according to the roll of two dice.

2 Claims, 5 Drawing Sheets

FOUR PLAYER BACKGAMMON

BACKGROUND OF INVENTION

Over the past centuries the conventional game of backgammon has been played by two players playing with 15 stones each. The 15 stones of each player are placed on the game board at certain predetermined starting positions and the players move their stones in opposite directions in a race to remove their respective stones from their inner table first and thereby be the winner. Choutte was developed as a variation of the conventional backgammon game to allow more than two players to play whereby one player plays in opposition to the rest of the players who have a team captain. The players with the team captain can not play individually but must develop a common strategy against the single player.

Recent multiplayer backgammon games include:

1. Thomas et al in U.S. Pat. Nos. 4,058,318 and 4,058,319 discloses game boards which have 48 or more total points with each player having 15 stones to move from prearranged starting positions on the game board.
2. Gilliland in U.S. Pat. No. 4,496,157 discloses a three player game board with 36 total points with each player having 15 stones to move from prearranged starting positions on the game board.
3. Borland in U.S. Pat. No. 4,556,221 discloses a backgammon board game for three players with a game board having 36 total points with each player having 20 stones to move from prearranged starting posiitons on the game board.
4. Barber in U.S. Pat. No. 4,286,787 discloses a four player backgammon game board having a total of 36 points with each player having 15 stones to move from prearranged starting positions on the game board.
5. Tobin et al in U.S. Pat. No. 4,549,739 discloses a game apparatus for use in backgammon games in which the game board has 48 total points and variations of games whereby each player has 6,12, or 15 stones to play from prearranged starting positions on the game board dependent upon which game is played.
6. Rosen in U.S. Des. Pat. No. 265,215 illustrates a four sided square game board having 12 points on each side yielding a total of 48 points on the game board.
7. Lane et al in U.S. Pat. No. 4,342,458 discloses a multiplayer backgammon game board which has a total of 28 points with each player having 10 stones to move from prearranged starting positions.
8. Othon in U.S. Des. Pat. No. 160,525 illustrates a six sided game board having 6 points on each side yielding a total of 36 points on the game board.
9. Sternau in U.S. Des. Pat. No. 85,066 illustrates a three sided game board having a total of 36 points on the game board.
10. Hirtenstein in U.S. Des. Pat. No. 84,477 illustrates a four sided square game board having 12 points on each side yielding a total of 36 points on the game board.

SUMMARY OF INVENTION

The present invention of a four layer backgammon game board is a basic four sided game board consisting of 24 total points of alternating colors with groups of six points located at the center of each of the four sides of the game board.

Three different variations of the basic game board are determined by color coding the outer table (points of entry to the game board) and inner table (points of bearing off the game board) according to the respective color of each player's stones.

Each of four players plays with optimally 9 stones of the same color but different in color from those of the other players and all players begin the game with no stones on the game board. There is no prearranged starting positions of the player's stones on the game board. Instead, each player must enter his colored stones on to his respective color coded outer table according to the roll of two dice. The player then proceeds around the 24 point game board in the direction of his respective color coded arrow and bears off his stones from his respective color coded inner table according to the general rules of the conventional two player backgammon game with a few exceptions. Games may be played individually or in partnership pairs.

DESCRIPTION OF INVENTION

Figure 1:
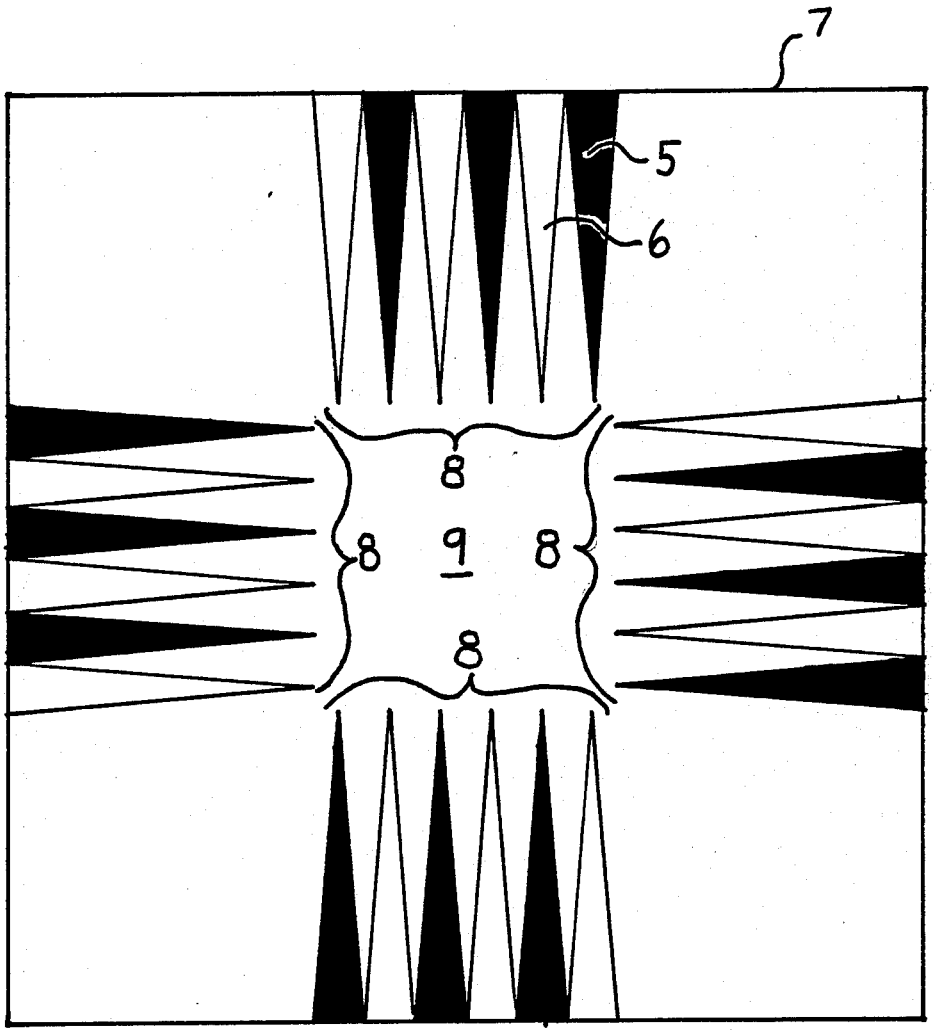
FIG. 1 illustrates the basic game board which has groups of 6 points located at the center of each of the four sides of the square game board. This game board is called "Gammon 4".
Figure 2:
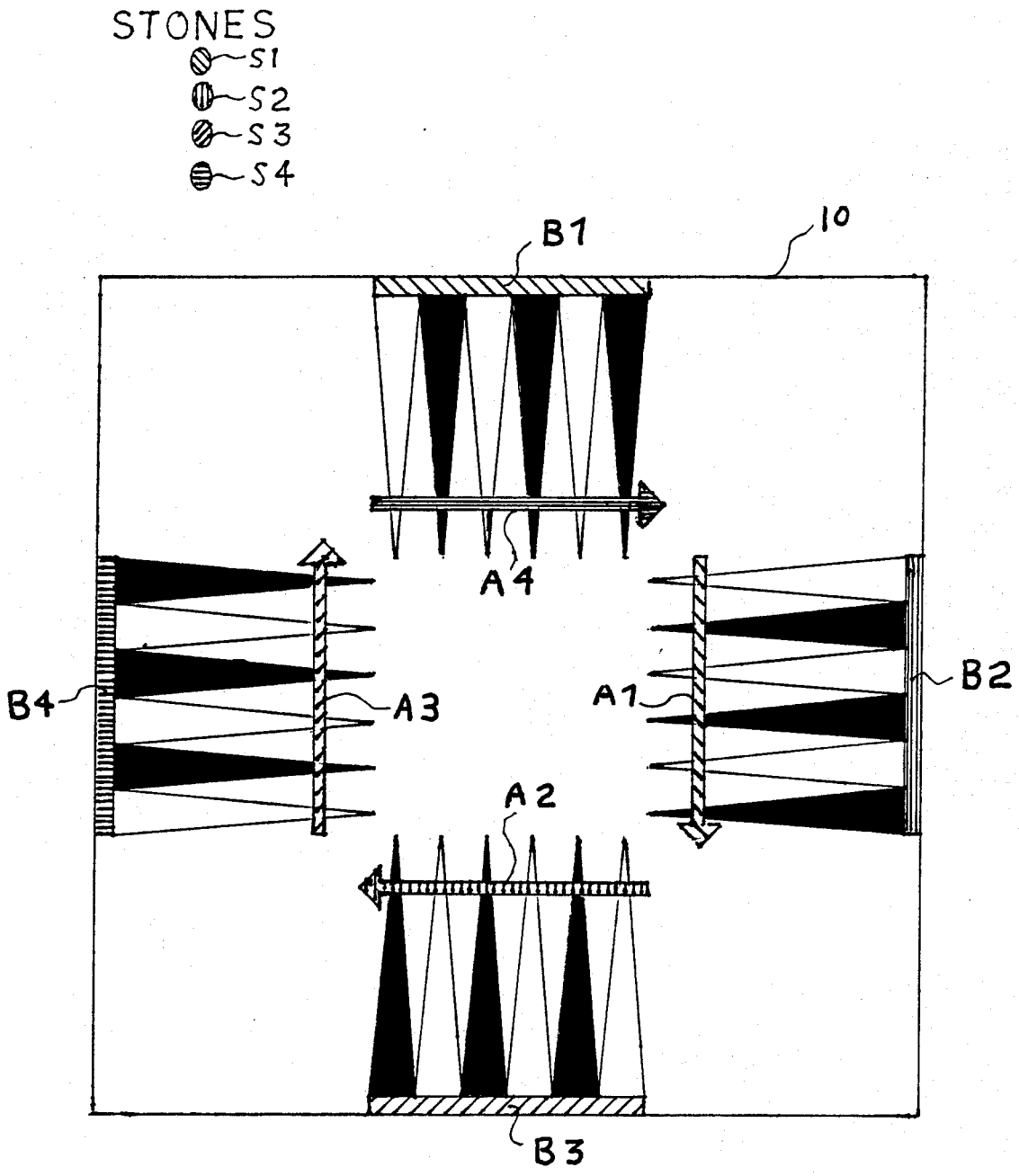
FIG. 2 illustrates the basic game board of FIG. 1 modified by color coded bands and arrows which determine the inner tables, outer tables and direction of play of each player having the corresponding colored stones. This game board is called "Gammon 4 - Challenge #1".
Figure 3:
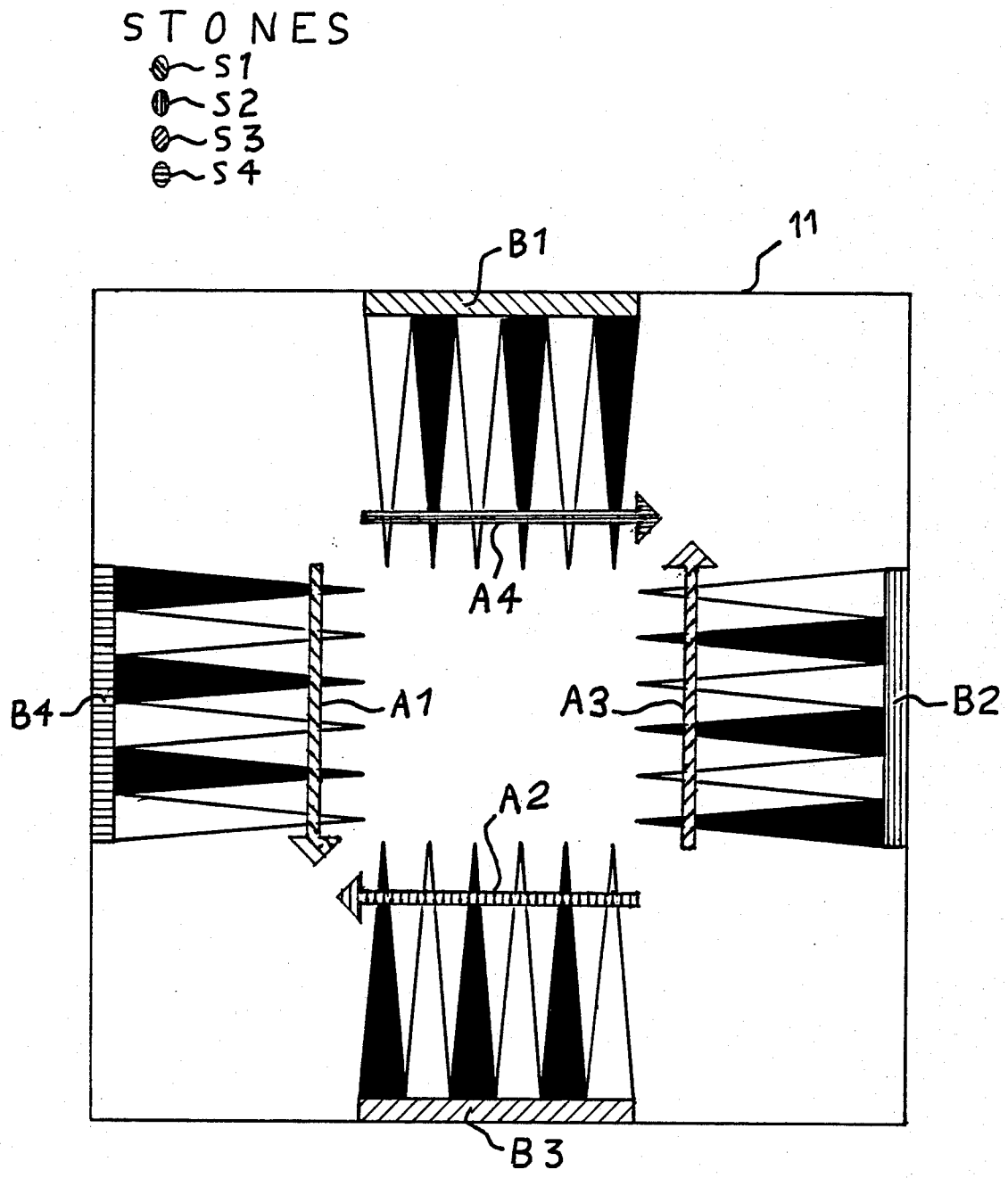
FIG. 3 illustrates the basic game board of FIG. 1 modified in a different manner than the game board illustrated in FIG. 2 by color coded bands and arrows which determine the inner tables, outer tables, and direction of play of each player having the corresponding colored stones. This game board is called "Gammon 4 - Challenge #2".
Figure 4:
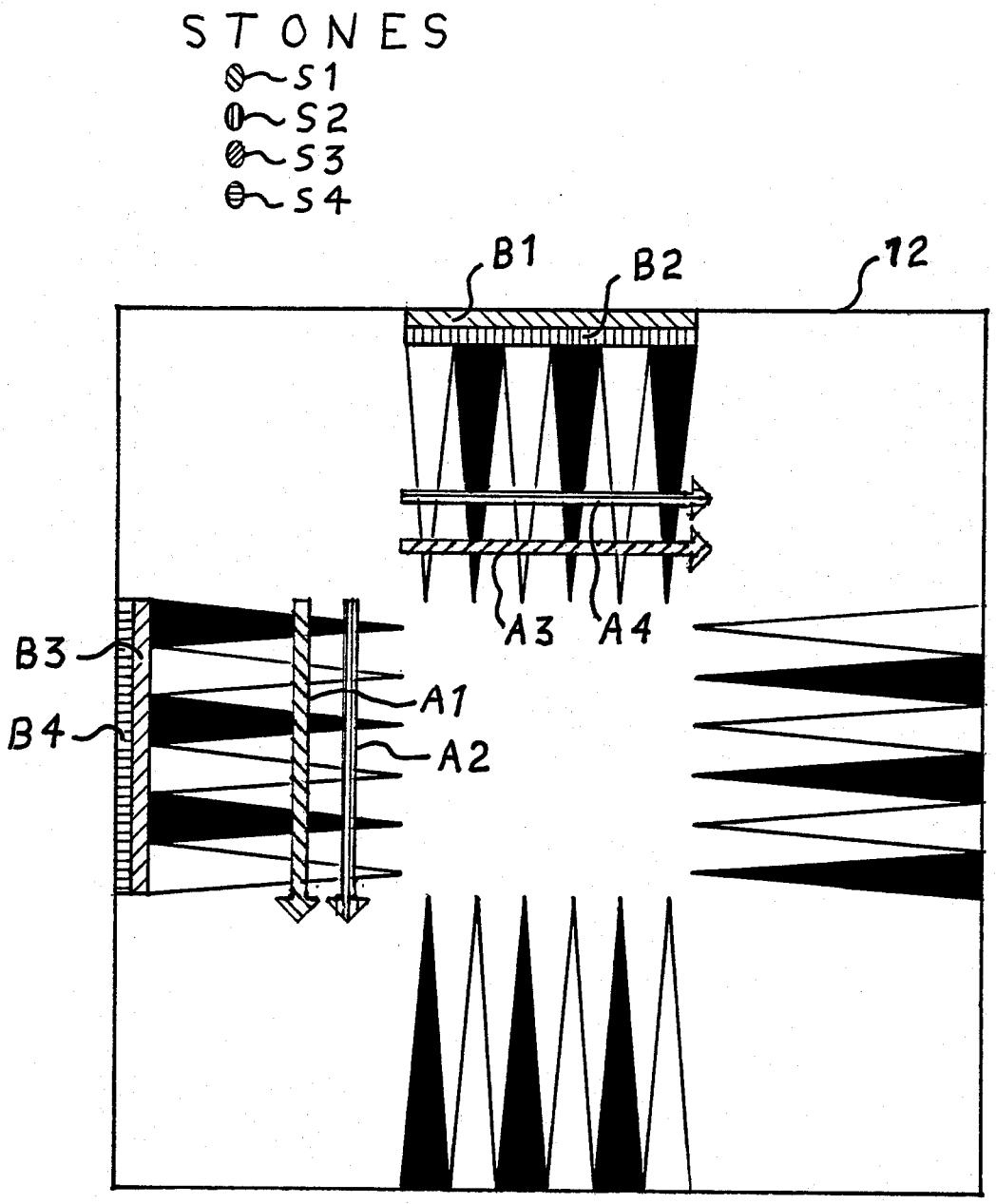
FIG. 4 illustrates the basic game board of FIG. 1 modified in a different manner than the game boards illustrated in FIGS. 2 and 3 by color coded bands and arrows which determine the inner tables, outer tables and direction of play of each player having the corresponding colored stones. This game board is called "Gammon 4 - Challenge #3".

This novel game called "Gammon 4" TM is a new four player backgammon game consisting of a basic square configuration four sided game board 7 illustrated in FIG. 1. Four groups of six adjacent points 8 of alternating colors 5,6 are located at the center of each side of the game board 7. The BAR as used in backgammon play is located at the center 9 of the game board 7. Variations of the game board 7 illustrated in FIG. 1 are illustrated in FIGS. 2,3, and 4 according to different layouts and color coding of game boards 10,11, and 12 respectively. Also illustrated are the four different sets of colored stones S1,S2,S3,S4 used by the players during a four player backgammon game.

FIG. 2 illustrates a gameboard 10 which is called "Gammon 4 - Challenge #1". This game board is a color coded modification of the basic game board 7 illustrated in FIG. 1 and is one of three different game boards establishing three different four player backgammon games.

This game board 10 has color coded arrows A1,A2-,A3,A4 and color coded bands B1,B2,B3,B4 which are used in conjunction with the color coded stones S1,S2,S3,S4 of the players. The four arrows A1,A2,A3-,A4 are of four different colors and each arrow defines the adjacent six point outer table of each player according to the player's respective colored stones S1,S2,S3,S4. The four bands B1,B2,B3,B4 are of four different colors respectively the same colors of the four arrows A1,A2,A3,A4 and each band defines the six point inner table of each player according to the player's respective colored stones S1,S2,S3,S4.

The configuration of the game board 10 is such that the six point outer table designated by arrow A1 is the six point inner table designated by band B2; the six point outer table designated by arrow A2 is the six point inner table designated by band B3; the six point outer table designated by arrow A3 is the six point inner table designated by band B4; and the six point outer table designated by arrow A4 is the six point inner table designated by band B1.

Arrow A1, band B1, and stones S1 are the same color #1; arrow A2, band B2, and stones S2 are the same color #2; arrow A3, band B3, and stones S3 are the same color #3; and arrow A4, band B4, and stones S4 are the same color #4. Colors #1,#2,#3, and #4 are all different from each other. When each player selects his color of stones with which to play, he accordingly must use the corresponding color of arrow designating his outer table and the corresponding color of band designating his inner table.

The game board 10 is arranged such that each player must enter his stones on to his assigned outer table according to the roll of two dice; proceed to move his stones in the direction of his assigned arrow to his assigned inner table; and then bear off his stones from his inner table. For example - the player with color stones S1 must enter his stones on to his outer table designated by the same color arrow A1 and then move his stones in the direction of arrow A1 to his inner table designated by the same color band B1 from which he bears off his color stones S1.

When the game begins, none of the players have any of their stones on the game board 10. The object of the game is for the players to enter their stones on to their respective color coded outer tables, proceed to move their respective colored stones in the direction of their respective color coded arrows to their respective color coded inner table from which they bear off their stones. The player who bears off all his stones first wins. All players move their stones through a field of 24 points from their respective outer tables to their respective inner tables when playing on game board 10. Players are each assigned optimally nine stones of a different color than the other players with which to play. Although the game could be played with more or less than nine stones per player, nine stones per player limits the number of stones in a four layer backgammon game to thirty six stones total which alleviates congestion and allows continuity of play on the 24 point game board 10. In the "Gammon 4 - Challenge #1" game, all players move their respective stones in the same clockwise direction as indicated by the colored arrows A1,A2,A3-,A4.

Players can play individually or in partnership pairs whereby players with inner tables B1 and B3 would play in partnership against the players with inner tables B2 and B4.

The general rules of the conventional backgammon apply except as follows:

A. At the beginning of each game, none of the players have stones on the game board. Each player must enter their stones on to their color coded outer tables designated by their respective color arrows A1,A2,A3,A4 according to the roll of two dice. The head of each arrow is the number 6 point of entry and the tail of each arrow is the number 1 point of entry to the designated outer table.

B. To begin the game, each player rolls one die and the player who rolls the highest number starts the game by rolling both dice again and entering two of his stones on to his color coded outer table accordingly. Once a player has entered two or more of his stones on to the game board 10, he may elect to enter more stones to his outer table on subsequent plays or move the two or more stones already entered on to the game board. Upon completion of the moves of any player, play moves to the next player to his left.

C. The direction of movement of each player's stones is determined by the direction of the colored arrows A1,A2,A3,A4 that correspond with the color of the respective player's stones S1,S2,S3,S4.

D. In the event a player rolls doubles, he first moves his stone(s) four times the number of one die and then subtracts that number from seven and then moves his stone(s) four times the resulting number. If a player is able to complete all the above moves, he must roll the dice again and move his stone(s) accordingly. If a player is unable to complete the above moves, he relinquishes the dice to the next player to his left.

FIG. 3 illustrates a different game board 11 which is called "Gammon 4 - Challenge #2". Game board 11 is a second color coded modification of the basic game board 7 illustrated in FIG. 1 and is different than the color coded game board 10 illustrated in FIG. 2. The game board 11 in FIG. 3 is the same in all respects to game board 10 in FIG. 2 except for the positions and directions of the colored arrows A1 and A3. On game board 11, the outer table designated by arrow A1 is the inner table designated by band B4 and the outer table designated by arrow A3 is the inner table designated by band B2. Arrows A1 and A3 of the game board 11 point in the counter clockwise direction. The players with corresponding colored stones S1 and S3 must move their stones in the counter clockwise direction of their respective arrows A1 and A3 in opposition to the direction of of the players using colored stones S2 and S4 who must move their stones in the clockwise direction as designated by the direction of their respective arrows A2 and A4.

In this "Gammon 4 - Challenge #2 game, each player must play through the opposing movement of stones of two other players as he progresses from his outer table to his inner table.

Players can play in partnership pairs on the game board 11 in a four player game whereby players with inner tables B1 and B3 would play in partnership against the players with inner tables B2 and B4.

The general rules of conventional backgammon apply except for the exceptions given previously.

FIG. 4 illustrates another game board 12 which is called "Gammon 4 - Challenge #3". The game board 12 is a third color coded modification of the basic game board 7 illustrated in FIG. 1 and is different in color coded configuration than game boards 10 and 11 of FIG. 2 and 3 respectively. Game board 12 is color coded with arrows A1,A2,A3,A4 and bands B1,B2,B3,B4 such that bands B1 and B2 define a common six point inner table and bands B3 and B4 define a common six point inner table which is perpendicular to the inner table defined by bands B1 and B2. Arrows A1 and A2 define a common six point outer table which is perpendicular to the six point outer table defined by arrows A3 and A4. The outer table defined by arrows A1 and A2 is the same six points of the inner table defined by bands B3 and B4 and the outer table defined by arrows A3 and A4 is the same six points of the inner table defined by bands B1 and B2.

When playing on this game board 12, two players must enter their stones on to a common outer table defined by arrows A1 and A2 while the other two players must enter their stones on to the other common outer table defined by arrows A3 and A4.

In this "Gammon 4 - Challenge #3" game, each player enters his stones on to the game board 12 at a common outer table in opposition to a second player attempting to enter his stones on to the same outer table. Once the players continue moving their respective stones in the direction of their respective color coded arrows, they again meet opposition of the players moving their stones in the opposite direction as designated by their respective color coded arrows.

If the game is played in partnership pairs, players with inner tables B1 and B3 should be paired against the players with inner tables B2 and B4.

The general rules of conventional backgammon apply except for the exceptions given previously. In all three four player backgammon game boards described:

1. The player using color stones S1 must enter his stones on to his six point outer table defined by the same color arrow A1 and then move stones S1 in the direction of arrow A1 to his six point inner table defined by the same color band B1 from which he bears off his stones S1.

2. The player using color stones S2 must enter his stones on to the six point outer table defined by the same color arrow A2 and then move his stones S2 in the direction of arrow A2 to his six point inner table defined by the same color band B2 from which he bears off his stones S2.

3. The player using stones S3 must enter his stones on to the six point outer table defined by the same color arrow A3 and then move his stones in the direction of arrow A3 to his six point inner table defined by the same color band B3 from which he bears off his stones.

4. The player using color stones S4 must enter his stones on to the six point outer table defined by the same color arrow A4 and then move his stones S4 in the direction of arrow A4 to his six point inner table defined by the same color band B4 from which he bears off his stones S4.

The variations of play of the four player backgammon game board 7 of FIG. 1 as depicted by game board 10 in FIG. 2, game board 11 in FIG. 3, and game board 12 in FIG. 4 determine the degree of difficulty, challenge and strategy of each game by changing the locations of the outer tables as defined by colored arrows A1,A2,A3,A4; the locations of the inner tables as defined by the colored bands B1, B2,B3,B4; and the direction of movement of the player's stones S1,S2,S3,S4 as defined by the direction of the colored arrows A1,A2-,A3,A4.

Figure 5:
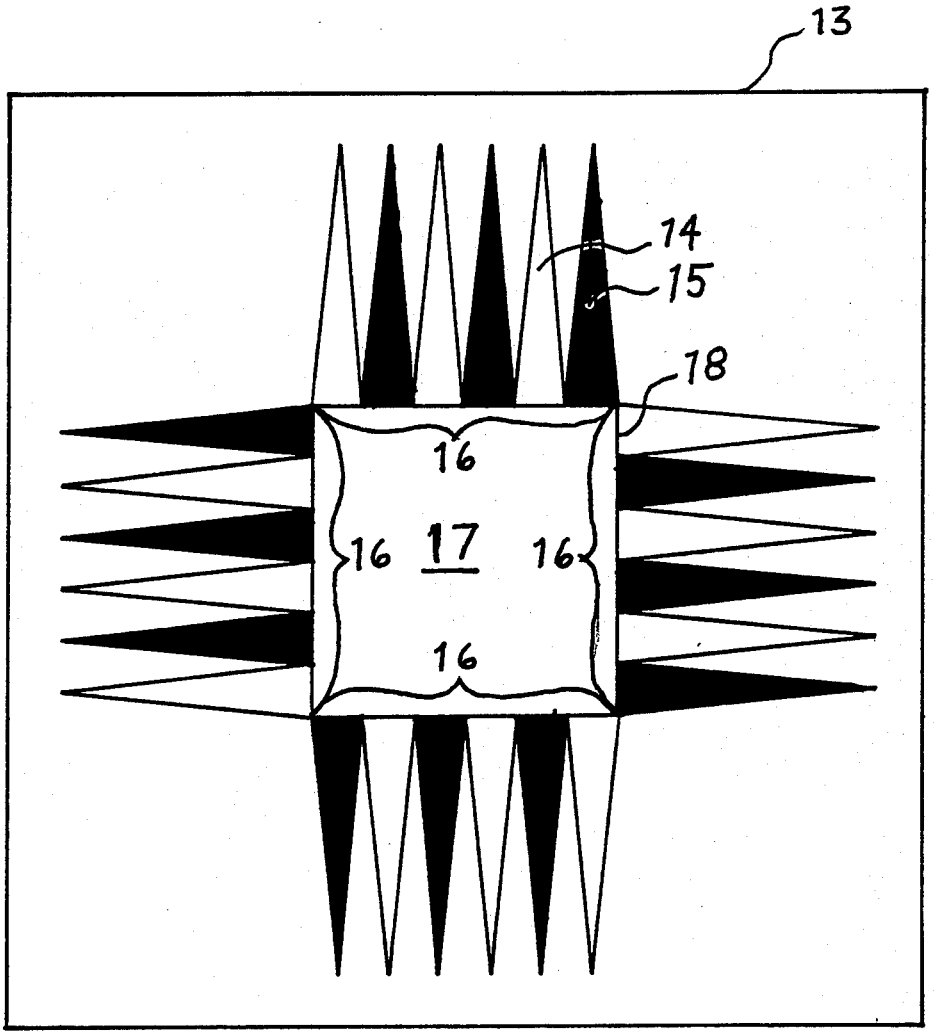
FIG. 5 illustrates another basic game board configuration which may be substituted as an alternate game board to the game board illustrated in FIG. 1.

FIG. 5 illustrates a basic game board of a different but similar design to the basic game board 7 illustrated in FIG. 1. The design of game board 13 is such that the groups of six points 16 of alternating colors 14,15 are located at each of the four sides of an inner square 18 which encompasses the BAR 17. The groups of six points 16 of game board 13 are pointing away from the center of the game board 13 whereas the group of six points 8 of game board 7 in FIG. 1 are pointing toward the center of the game board 7.

This game board 13 configuration may be substituted for the basic game board 7 of FIG. 1 in the application of the color coded game board modifications previously described to provide the game play described as "Gammon 4 - Challenge #1", "Gammon 4 - Challenge #2", and "Gammon 4 - Challenge #3".

I claim:

1. A four player backgammon game board comprising:

four groups of six adjacent isosceles triangles of two alternating colors, the bases of said isosceles triangles being oriented along the edges of the game board and the apexes of said isosceles triangles being oriented toward the center of the game board, and four different color coded rectangular shaped bands, each having a length approximately equal to the length of the sum of the bases of one of said groups of six adjacent isosceles triangles and a width approximately equal to one third the width of the base of one isosceles triangle, the location of each of said bands being between the bases of chosen groups of six isosceles triangles and the corresponding edge of the game board, the placement of said color coded bands determines the location of each players inner table from which he bears off his respective colored stones in a race to win the game, and four different color coded arrows of colors matching the colors of said four different color coded bands and of lengths approximately equal to the lengths of said four different color coded bands, the location of each arrow being adjacent to the apexes of chosen groups of six isosceles triangles, the placement of said arrows on the game board determines the location of each players outer table on to which each player must enter his respective colored stones to begin the game, said arrows providing a means to determine the direction of movement of each player's respective colored stones.

2. The four player backgammon game board of claim 1 wherein said corresponding color coded arrows and bands are positioned on the game board to cause each player with the corresponding colored stones to move his stones through a field of 24 points from his respective outer table to his respective inner table.

* * * * *